US012371989B1

(12) United States Patent
Ilamah et al.

(10) Patent No.: US 12,371,989 B1
(45) Date of Patent: Jul. 29, 2025

(54) REDUCING AN ACID GAS CONCENTRATION IN WELL PRODUCTION

(71) Applicant: Saudi Arabian Oil Company, Dhahran (SA)

(72) Inventors: Oshokhayamhe Ilamah, Dhahran (SA); Hatim S. AlQasim, Dammam (SA); Hussain A. Aborshaid, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/427,213

(22) Filed: Jan. 30, 2024

(51) Int. Cl.
*E21B 34/06* (2006.01)
*E21B 47/10* (2012.01)

(52) U.S. Cl.
CPC ..... *E21B 47/10* (2013.01); *E21B 34/06* (2013.01)

(58) Field of Classification Search
CPC ..... E21B 34/06; E21B 47/10
USPC ..... 166/250.01
See application file for complete search history.

(56) References Cited

U.S. PATENT DOCUMENTS 9,388,686 B2 7/2016 Konopczynski et al.
11,970,927 B1 4/2024 Aborshaid et al.
2015/0144333 A1* 5/2015 Lee ..... E21B 47/107 166/250.01
2020/0173273 A1* 6/2020 Thiruvenkatanathan ..... G01V 1/288
2021/0115786 A1* 4/2021 Cerrahoglu ..... E21B 47/135
2021/0148199 A1* 5/2021 Thiruvenkatanathan ..... E21B 43/121
2021/0388716 A1* 12/2021 Cerrahoglu ..... E21B 47/107

OTHER PUBLICATIONS

Barsoum et al., "Diluting Acid Gases With Sweet Gases in Gas Lift Systems: Assessment, Challenges, and Recommendations," Presented at the SPE Annual Technical Conference and Exhibition, Dallas, Texas, Oct. 2005, 12 pages.
Guo et al., "Production Enhancement in Deep Sour Gas Field: A Case Study in China, " SPE-202012-MS, Oct. 26, 2020, 12 pages.
Ilamah et al., "Field-Scale Production Optimization with Intelligent Wells," Presented at the SPE Europec featured at 80th EAGE Conference and Exhibition, Copenhagen, Denmark, Jun. 2018, 12 pages.

(Continued)

*Primary Examiner* — William D Hutton, Jr.
*Assistant Examiner* — Ashish K Varma
(74) *Attorney, Agent, or Firm* — Fish & Richardson P.C.

(57) ABSTRACT

Techniques for controlling an amount of an acid gas in a production fluid includes operating a completion assembly that includes a production tubular, a first zone completion assembly, and a second zone completion assembly. The techniques include circulating a first formation fluid into the production tubular with a first flow control valve; circulating a second formation fluid into the production tubular with a second flow control valve; determining an amount or percentage of an acid gas in a production fluid that includes a mixture of the first and second formation fluids; comparing the determined amount of percentage to a threshold value; and modulating at least one of the first or second flow control valves in response to the comparison so that the production fluid meets the threshold value of the amount or percentage of the acid gas.

26 Claims, 6 Drawing Sheets

(56) References Cited

OTHER PUBLICATIONS

Mubashir et al., "Sour Gas Well Testing Challenges—A Successful Case Study," Prepared for presentation at the Abu Dhabi International Petroleum Exhibition & Conference held in Abu Dhabi, UAE, Nov. 11-14, 2019, 17 pages.
Sturman et al., "Control of Hydrogen Sulfide in Oil and Gas Wells With Nitrite Injection," Prepared for presentation at the 1999 SPE Annual Technical Conference and Exhibition held in Houston, Texas, Oct. 3-6, 1999, 7 pages.
Thompson et al., "Predicting the Reservoir Response to Intelligent Wells," Prepared for presentation at the SPE European Petroleum Conference held in Paris, France, Oct. 24-25, 2000, 25 pages.
Wilhelm et al., "Selection of Materials for Sour Service in Petroleum Production," Journal of Petroleum Technology, Oct. 1986, pp. 1051-1061, 11 pages.

* cited by examiner

REDUCING AN ACID GAS CONCENTRATION IN WELL PRODUCTION

TECHNICAL FIELD

This disclosure relates to systems and methods for reducing an acid gas concentration in well production, such as hydrogen sulfide in a produced hydrocarbon fluid.

BACKGROUND

As the global demand for hydrocarbons grows, hydrocarbon reservoirs with high acid gas content, such as hydrogen sulfide ($H_2S$) content, have to be developed and exploited. However, acid gas at high concentration levels can be life-threatening, corrosive, highly flammable, or generally unsafe. Production operations at high acid gas fields therefore has to be undertaken under very strict safety regime. In many instances, safe production operation is not possible due to high acid gas levels and this leads to reserves write-off.

SUMMARY

In an example implementation, a downhole completion assembly includes a production tubular installed in a wellbore from a terranean surface into a first subterranean zone and a second subterranean zone. The first subterranean zone includes a first formation fluid that includes a hydrocarbon fluid and a first concentration or amount of an acid gas, and the second subterranean zone includes a second formation fluid that includes the hydrocarbon fluid and a second concentration or amount of the acid gas different than the first concentration. The downhole completion assembly includes a first zone completion assembly coupled to the production tubular in the wellbore adjacent the first subterranean zone, where the first zone completion assembly includes at least one first flow control valve configured to circulate the first formation fluid into the production tubular. The downhole completion assembly includes a second zone completion assembly coupled to the production tubular in the wellbore adjacent the second subterranean zone, where the second zone completion assembly includes at least one second flow control valve configured to circulate the second formation fluid into the production tubular. The downhole completion assembly includes a control system configured to perform operations including comparing an amount or percentage of the acid gas in a production fluid to a threshold value, the production fluid including a mixture of the first and second formation fluids; and modulating at least one of the first or second flow control valves in response to the comparison so that the production fluid meets the threshold value of the amount or percentage of the acid gas.

An aspect combinable with the example implementation includes at least one wellbore seal positioned in an annulus between the production tubular and the wellbore and between the first and second zone completion assemblies.

Another aspect combinable with any of the previous aspects includes at least one sensor coupled to the production tubing and configured to sense the amount or percentage of the acid gas in the production fluid, wherein the operations include comparing the sensed amount or percentage of the acid gas in the production fluid to the threshold value.

In another aspect combinable with any of the previous aspects, the first zone completion assembly includes a first flow meter configured to measure a flow rate of the first formation fluid circulated into the production tubular, and the second zone completion assembly includes a second flow meter configured to measure a flow rate of the second formation fluid circulated into the production tubular.

In another aspect combinable with any of the previous aspects, the operations include determining a first amount of the acid gas in the flow of the first formation fluid based on the measured flow rate of the first formation fluid by the first flow meter and the first concentration or amount; determining a second amount of the acid gas in the flow of the second formation fluid based on the measured flow rate of the second formation fluid by the first flow meter and the second concentration or amount; and determining the amount or percentage of the acid gas in the production fluid based on the determined first and second amounts and the measured flow rates of the first and second formation fluids.

In another aspect combinable with any of the previous aspects, the first and second concentration or amounts are specified values based on the first and second subterranean zones.

In another aspect combinable with any of the previous aspects, the operation of determining the amount or percentage of the acid gas in the production fluid based on the determined first and second amounts and the measured flow rates of the first and second formation fluids includes determining a volume weighted average of the amount or percentage of the acid gas in the production fluid based on the determined first and second amounts and the measured flow rates of the first and second formation fluids.

In another aspect combinable with any of the previous aspects, the first and second flow control valves include remotely controlled inflow control valves.

In another aspect combinable with any of the previous aspects, the operation of modulating at least one of the first or second flow control valves in response to the comparison so that the production fluid includes the threshold value of the amount or percentage of the acid gas includes providing at least one signal from the terranean surface to the at least one of the first or second flow control valves to cause modulation of the at least one of the first or second flow control valves.

In another aspect combinable with any of the previous aspects, the operation of modulating at least one of the first or second flow control valves in response to the comparison so that the production fluid meets the threshold value of the amount or percentage of the acid gas includes modulating the first and second flow control valves in response to the comparison so that the production fluid meets the threshold value of the amount or percentage of the acid gas.

In another aspect combinable with any of the previous aspects, the second concentration or amount of the acid gas is less than the first concentration or amount of the acid gas.

In another aspect combinable with any of the previous aspects, the first concentration or amount of the acid gas includes a concentration of about 20 mol % of the acid gas, and the second concentration or amount of the acid gas includes a concentration of about 0 mol % of the acid gas.

In another aspect combinable with any of the previous aspects, the acid gas includes hydrogen sulfide.

In another example implementation, a method of controlling an amount of an acid gas in a production fluid includes operating a completion assembly in a wellbore. The completion assembly includes a production tubular installed in the wellbore from a terranean surface into a first subterranean zone and a second subterranean zone, a first zone completion assembly coupled to the production tubular in the wellbore adjacent the first subterranean zone, and a second zone completion assembly coupled to the production tubular in the wellbore adjacent the second subterranean zone. The first subterranean zone includes a first formation fluid that includes a hydrocarbon fluid and a first concentration or amount of an acid gas. The second subterranean zone includes a second formation fluid that includes the hydrocarbon fluid and a second concentration or amount of the acid gas different than the first concentration. The first zone completion assembly includes at least one first flow control valve; and the second zone completion assembly includes at least one second flow control valve. The method includes circulating the first formation fluid into the production tubular with the first flow control valve; circulating the second formation fluid into the production tubular with the second flow control valve; determining an amount or percentage of the acid gas in a production fluid that includes a mixture of the first and second formation fluids; comparing the determined amount of percentage to a threshold value; and modulating at least one of the first or second flow control valves in response to the comparison so that the production fluid meets the threshold value of the amount or percentage of the acid gas.

An aspect combinable with the example implementation includes fluidly separating the first and second formation fluids in an annulus with at least one wellbore seal positioned in the annulus between the production tubular and the wellbore and between the first and second zone completion assemblies.

Another aspect combinable with any of the previous aspects includes sensing, with at least one sensor coupled to the production tubing, the amount or percentage of the acid gas in the production fluid; and comparing the sensed amount or percentage of the acid gas in the production fluid to the threshold value.

Another aspect combinable with any of the previous aspects includes determining a flow rate of the first formation fluid circulated into the production tubular with a first flow meter of the first zone completion assembly; and determining a flow rate of the second formation fluid circulated into the production tubular with a second flow meter of the second zone completion assembly.

Another aspect combinable with any of the previous aspects includes determining a first amount of the acid gas in the flow of the first formation fluid based on the measured flow rate of the first formation fluid by the first flow meter and the first concentration or amount; determining a second amount of the acid gas in the flow of the second formation fluid based on the measured flow rate of the second formation fluid by the first flow meter and the second concentration or amount; and determining the amount or percentage of the acid gas in the production fluid based on the determined first and second amounts and the measured flow rates of the first and second formation fluids.

In another aspect combinable with any of the previous aspects, the first and second concentration or amounts are specified values based on the first and second subterranean zones.

In another aspect combinable with any of the previous aspects, determining the amount or percentage of the acid gas in the production fluid based on the determined first and second amounts and the measured flow rates of the first and second formation fluids includes determining a volume weighted average of the amount or percentage of the acid gas in the production fluid based on the determined first and second amounts and the measured flow rates of the first and second formation fluids.

In another aspect combinable with any of the previous aspects, the first and second flow control valves include remotely controlled inflow control valves.

In another aspect combinable with any of the previous aspects, modulating at least one of the first or second flow control valves in response to the comparison so that the production fluid includes the threshold value of the amount or percentage of the acid gas includes providing at least one signal from the terranean surface to the at least one of the first or second flow control valves to cause modulation of the at least one of the first or second flow control valves.

In another aspect combinable with any of the previous aspects, modulating at least one of the first or second flow control valves in response to the comparison so that the production fluid includes the threshold value of the amount or percentage of the acid gas includes modulating the first and second flow control valves in response to the comparison so that the production fluid includes the threshold value of the amount or percentage of the acid gas.

In another aspect combinable with any of the previous aspects, the second concentration or amount of the acid gas is less than the first concentration or amount of the acid gas.

In another aspect combinable with any of the previous aspects, the first concentration or amount of the acid gas includes a concentration of about 20 mol % of the acid gas, and the second concentration or amount of the acid gas includes a concentration of about 0 mol % of the acid gas.

In another aspect combinable with any of the previous aspects, the acid gas includes hydrogen sulfide.

Implementations of systems and methods for reducing an acid gas concentration in a wellbore production fluid according to the present disclosure may include one or more of the following features. For example, implementations according to the present disclosure can allow safe exploitation of high and ultra-high acid gas hydrocarbon reserves and unlock production in high acid gas areas. Also, implementations according to the present disclosure can mitigate acid gas effects on downhole and surface equipment. Further, implementations according to the present disclosure can reduce producing RER values and acid gas content. In some aspects, implementations according to the present disclosure can enable production from sour wells with minimal effect on downhole and surface equipment, while being cost effective, easily controllable and scalable, and simple to operate. Also, implementations according to the present disclosure can be applied for undepleted reservoirs and do not require surface injection systems (compressors etc.).

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of systems and methods for reducing an acid gas concentration, such as hydrogen sulfide, carbon dioxide, or other acid gasses (or a combination thereof) in well production. Example implementations according to the present disclosure incorporate a well completion assembly that allows a safe, controllable, cost-effective and easily scalable downhole dilution of high acid gas reservoir fluids using multi-zone smart completions. In operation, the example well completion assembly provides for sour hydrocarbons to be diluted with sweet hydrocarbons downhole, reducing the acid gas content to safer levels before the production fluid is produced to a terranean surface.

In example implementations according to the present disclosure, the well completion assembly can include multiple zone completion assemblies to selectively control and actively manage formation fluid production from two or more subterranean zones (also called reservoirs) that are, for example, vertically near or adjacent each other. Each subterranean zone can store a formation fluid with a different concentration or amount of an acid gas (such as $H_2S$). The multiple formation fluids are mixed in a production tubing of the completion assembly as a production fluid that is circulated to the surface. By operation of the multiple zone completion assemblies, downhole mixing of the formation fluids and dilution of the acid gas concentration (and/or amount) in the production fluid can be achieved.

Generally, at least one of the subterranean zones contains "sweet" (or relatively low acid gas concentration) fluid as compared to the other zone(s) into which the well completion assembly is installed. Thus, in the example of two vertically adjacent (or near) subterranean zones, one of the zones is considered to store a sweet production fluid while the other zone is considered to store a "sour" (or relatively high acid gas concentration) fluid. In some aspects, the determination of which zone stores sweet fluid and which zone stores sour fluid is a straightforward determination of the relative concentration of acid gas (for example, by volume) in the two zone fluids.

Figure 1:
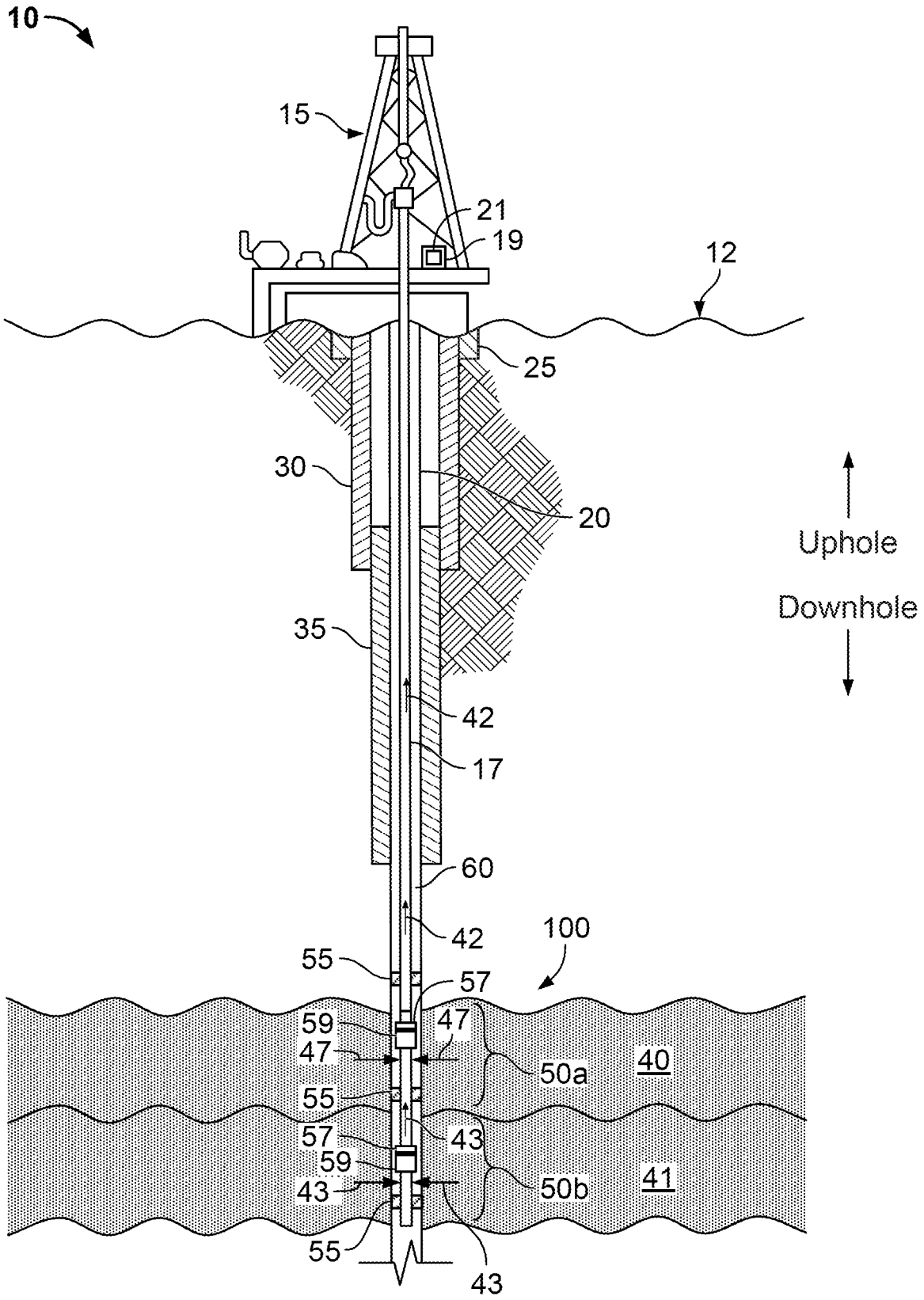
FIG. 1 is a schematic diagram of an example wellbore system that includes a wellbore completion assembly according to the present disclosure.

FIG. 1 is a schematic diagram of an example wellbore system 10 that includes a well completion assembly 100 according to the present disclosure. Implementations according to the present disclosure include the well completion assembly 100 that includes at least two zone completion assemblies 50*a* and 50*b*, each of which is a smart completion system that includes downhole smart valves that periodically modulate to allow production fluid 42 to flow to a terranean surface 12 through a production tubing 17 (or otherwise downhole tubing string).

As shown, the wellbore system 10 accesses subterranean zones 40 and 41, and provides access to formation fluids 47 and 43, respectively, located in such subterranean zones 40 and 41 (also called reservoirs 40 and 41). In an example implementation of system 10, the system 10 is used for a production operation to produce the production fluid 42 to the terranean surface 12; production fluid 42 is a mixture of the formation fluids 43 and 47. Thus, in some aspects, system 10 does not include a drilling rig but does include a wellhead with one or more surface valves as well as a valve control system to control the surface valves, one or more downhole smart valves, or both.

As illustrated in FIG. 1, an implementation of the wellbore system 10 includes the production assembly (or "assembly") 15 deployed on a terranean surface 12. The assembly 15 can generally represent a production rig that can be used to access the wellbore 20 extending from the terranean surface 12 and through one or more geological formations in the Earth. One or more subterranean zones (or formation), such as subterranean zones 40 and 41, are located under the terranean surface 12. Although shown as vertically adjacent, subterranean zones 40 and 41 can be vertically separated by one or more other reservoirs. One or more wellbore casings, such as a surface casing 30 and intermediate casing 35, may be installed in at least a portion of the wellbore 20 (for example subsequent to completion of the drilling operation or some other time).

In some embodiments, the assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Wellbore 20, generally, can be formed with any appropriate assembly or drilling rig used to form wellbores or boreholes in the Earth. The drilling assembly may use traditional techniques to form such wellbores, such as the wellbore 20, or may use nontraditional or novel techniques. In some embodiments, the drilling assembly may use rotary drilling equipment to form such wellbores. Rotary drilling equipment is known and may consist of a drill string and a drill bit (or bottom hole assembly that includes a drill bit). In some embodiments, the drilling assembly may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit (for example, as a bottom hole assembly). A swivel, which is attached to hoisting equipment, carries much, if not all of, the weight of the drill string, but may allow it to rotate freely.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As a production assembly, the assembly 15 can include certain aforementioned components, as well as the production string or tubing 17 through which the production fluid 42 (for example, a mixture of hydrocarbons, water, and one or more acid gasses) can be produced from subterranean zones 40 and 41 to the terranean surface 12. As shown in this example, the well completion assembly 100 is installed in or as part of the production tubing 17. One or more wellbore seals 55 (such as production tubing packers) can be installed in or adjacent the well completion assembly 100 to seal portions of the annulus 60 so as to force the formation fluids 43 and 47, as well as production fluid 42, to flow into the production tubing 17. In this example, the completion assembly 100 can facilitate a multi-zone completion (with multiple seals 55 and multiple zone completion assemblies 50*a* and 50*b*).

A shown in the example implementation of FIG. 1, there are two zone completion assemblies 50*a* and 50*b* that are installed in the well completion assembly 100 adjacent subterranean zones 40 and 41, respectively. In other implementations with more subterranean zones to be covered by the well completion assembly 100, there can be more zone completion assemblies (for example, one per zone). In this example, wellbore seals 55 are installed on the production tubular 17 so that formation fluids 43 and 47 do not mix in the annulus 60 but only mix to form production fluid 42 in the production tubing 17.

Each zone completion assembly 50*a* and 50*b* includes at least one flow control valve 59. The flow control valves 59 can be implemented, for example, as active flow control valves (inflow control valves or ICVs) or passive flow control valves (inflow control devices or ICDs). Generally, both ICVs and ICDs can be used to regulate the flow of formation fluids (such as formation fluids 43 and 47) from the zones 40 and 41 into the production tubing 17.

In the case of the flow control valves 59 being ICVs, each ICV can be remotely operated from a control system 19 through a downhole conveyance (not shown). The control system 19, in some aspects, can be a microprocessor based controller, but can also be implemented as a mechanical control system, an electro-mechanical control system, a hydraulic control system, or a combination thereof (as example).

In the case of the flow control valves 59 being ICDs, each ICD can be preset (for instance, a percentage opening preset) depending on, for example the potential of each subterranean zone 40/41 to produce respective formation fluids 43/47, the acid gas concentration or amount of each zone 40/41, the desired or threshold value of an acid gas concentration or amount of the production fluid 42 (which is a mixture of the formation fluids 43 and 47), or a combination thereof. In the case of the ICDs being incapable of remote control to modulate open or close, physical intervention to adjust ICD settings can be performed periodically to reflect changing conditions of the subterranean zones 40 and 41 (such as flow rate of the formation fluids 43 and/or 47 into the production tubing 17, acid gas concentrations of one or both of the formation fluids 43 and 47, or other conditions).

Optionally, and in this example implementation, each zone completion assembly 50*a* and 50*b* includes a flow meter 57 that is installed in the production tubing 17, as part of the flow control valve 59, or other location to measure a flow rate of the particular formation fluid 43 or 47 (depending on the zone completion assembly 50*a* or 50*b*) into the production tubing 17. The measured flow rates can be provided, for example, through the downhole conveyance coupled to the control system 19, to the control system 19 to perform operations as described herein.

Optionally, a sensor 21 can be installed in fluid communication with the production tubing 17, or otherwise operable to sense or measure a composition of the production fluid 42 that circulates to the terranean surface 12. In this example, the sensor 21 measures a concentration or amount of an acid gas (such as $H_2S$) in the production fluid 42. In some aspects, the sensor 21 is also communicably coupled to the control system 19 to transmit or otherwise provide the sensed acid gas concentration to the control system 19.

In an example operation of the well completion assembly 100, once installed in the wellbore 20 on the production tubing 17 (or as part of the production tubing 17), the flow control valves 59 of the respective zone completion assemblies 50*a* and 50*b* can be preset or modulated (for example, by the control system 19) to circulate respective flows of the formation fluids 43 and 47 from the subterranean zones 40 and 41 into the production tubing 17. Within the production tubing 17, the formation fluids 43 and 47 mix and combine to form the production fluid 42, which is produced to the terranean surface 12. During such circulation through the zone completion assemblies 50*a* and 50*b*, the respective flow meters 57 can measure the respective flow rates of the formation fluids 43 and 47 (and, for example, provide such measurements to the control system 19).

In this example operation, formation fluid 43 can be considered a sweet fluid, while formation fluid 47 can be considered a sour fluid (in other words, with a higher concentration of acid gas than the formation fluid 43). The resultant production fluid 42, therefore, can have a particular acid gas concentration depending on, for instance, the relative differences in acid gas content and flow rates of formation fluids 43 and 47.

Continuing with this example operation, a concentration or amount of acid gas in the production fluid 42 can be determined. In some examples, the concentration or amount of acid gas in the production fluid 42 can be determined by the sensor 21 (which directly measures such concentration).

In well completion assemblies that do not include a sensor 21 (or even in ones that do), the concentration or amount of acid gas in the production fluid 42 can be determined algorithmically by the control system 19 based at least in part on the measured volumetric flow rates of the formation fluids 43 and 47 and known or pre-determined acid gas concentrations of each of the formation fluids 43 and 47. For example, based on a rock type or other characteristic of the subterranean zones 40 and 41, an acid gas concentration within each zone 40 and 41 can be known (and stored, for instance, in the control system 19). The control system 19, therefore, can determine a concentration or amount of acid gas in the production fluid 42 by volume weighted average of the formation fluids 43 and 47. In addition, this concentration or amount determined by the volume weighted average can be compared against the measured concentration or amount by the sensor 21.

The control system 19 can compare the sensed or calculated concentration or amount of acid gas in the production fluid 42 against a threshold amount or concentration. For instance, the threshold amount of concentration can be a maximum value in which the acid gas in the production fluid 42 does not represent a hazard or an undesirable concentration or amount to produce to the surface 12.

If the concentration or amount of acid gas in the production fluid 42 is greater than a threshold amount or concentration, then one or both of the flow control valves 59 can be modulated to reduce the amount or concentration of the acid gas in the production fluid 42. For instance, flow control valve 59 in the zone completion assembly 50*a* can be closed or modulated toward closed to reduce the sour formation fluid 47 in the production fluid 42. Alternatively, or in addition, flow control valve 59 in the zone completion assembly 50*b* can be opened or modulated toward open to increase the sweet formation fluid 43 in the production fluid 42.

If the concentration or amount of acid gas in the production fluid 42 is less than the threshold amount or concentration, then one or both of the flow control valves 59 can also be modulated to increase the amount or concentration of the acid gas in the production fluid 42. For instance, flow control valve 59 in the zone completion assembly 50*a* can be opened or modulated toward open to increase the sour formation fluid 47 in the production fluid 42. Alternatively, or in addition, flow control valve 59 in the zone completion assembly 50*b* can be closed or modulated toward close to decrease the sweet formation fluid 43 in the production fluid 42. The steps of the example operation can be repeated as necessary through a production cycle of the wellbore 20.

Figure 2:
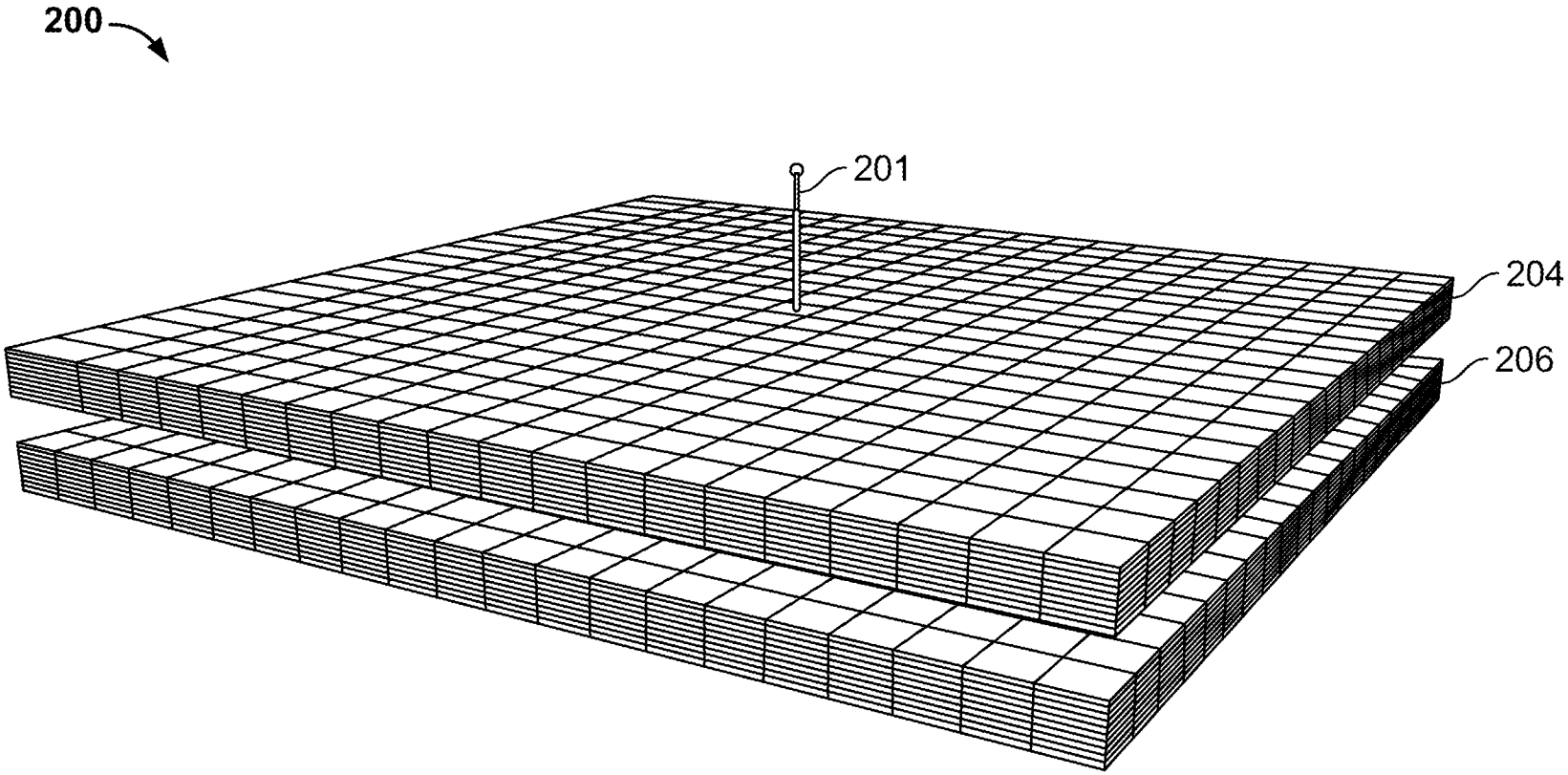
FIG. 2 is a schematic diagram of a reservoir model used to model operation of a wellbore completion assembly according to the present disclosure.
Figure 3:
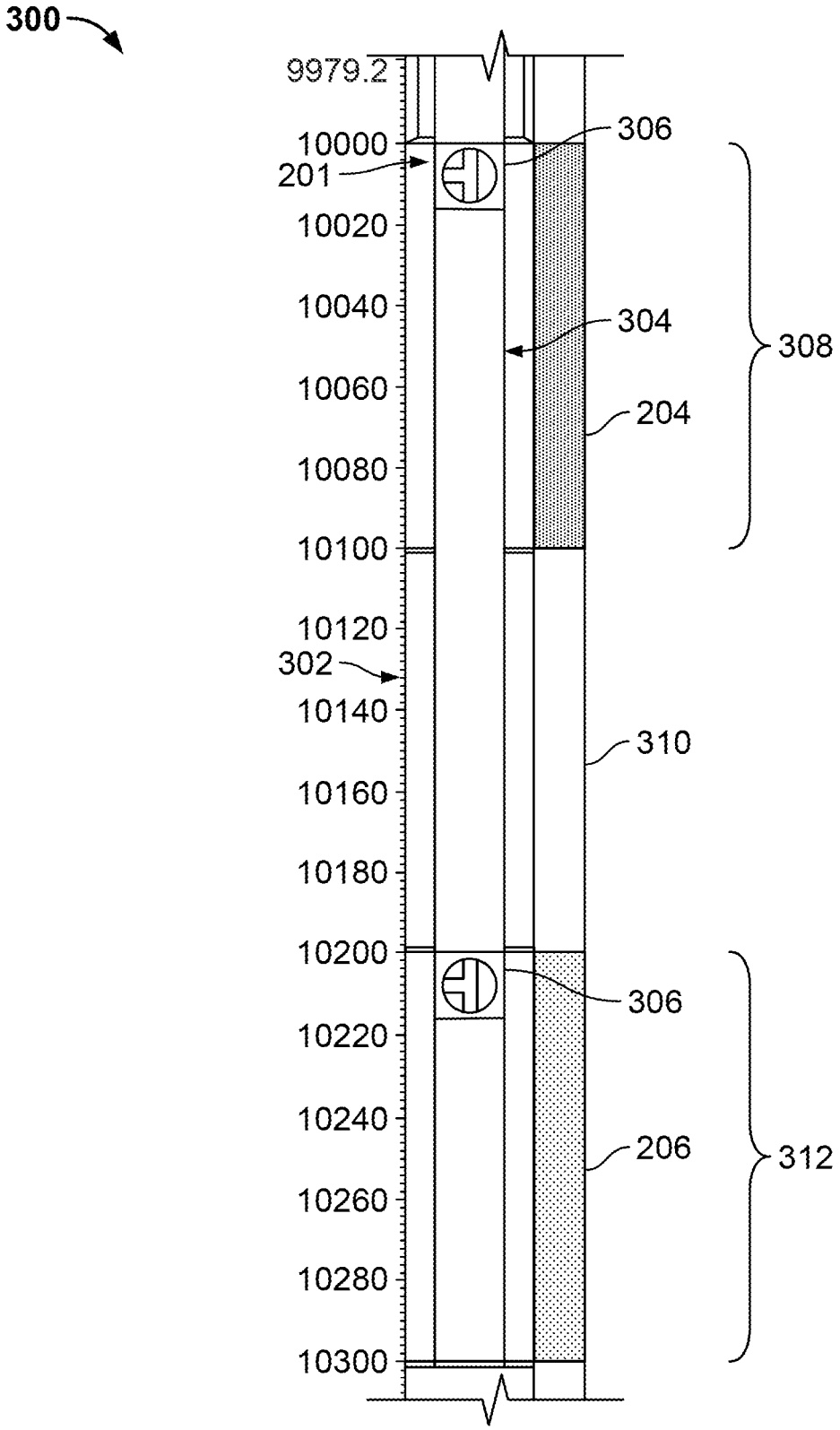
FIG. 3 is a schematic diagram of a wellbore completion assembly model used to model operation of a wellbore completion assembly according to the present disclosure.

The example implementation of the well completion assembly 100 shown in FIG. 1 was validated via a reservoir simulation (completed by Schlumberger ECLIPSE). For example, FIG. 2 is a schematic diagram (produced Schlumberger Petrel) of a reservoir model 200 used to model operation of the wellbore completion assembly 100 according to the present disclosure. Further, FIG. 3 is a schematic diagram of a wellbore completion assembly model 300 used to model operation of the wellbore completion assembly 100 according to the present disclosure.

As shown in the reservoir model 200, a wellbore 201 is modeled as formed through reservoirs (subterranean zones) 204 and 206. In this example, the reservoirs (subterranean zones) 204 and 206 are not directly vertically adjacent but instead, a gap (in other words, a non-producing formation) is vertically between reservoirs 204 and 206. The shallower reservoir 204 is initialized with a gas condensate fluid with very high $H_2S$ concentration (20.4 mol % $H_2S$). Conversely, the deeper reservoir 206 is initialized with a gas condensate fluid with no $H_2S$ (i.e. 0 mol % $H_2S$). The single production well 201 simultaneously targets both reservoirs 204 and 206 and the resulting production well stream characteristics were modeled. The simulation model 200 is fully compositional, which allowed the ability to track an individual fluid component (for example, $H_2S$) concentration in the production well stream (i.e., fluid) of the wellbore 201.

As shown in the wellbore completion assembly model 300, a wellbore completion assembly 304 is installed in the wellbore 201 at depths 302 associated with the reservoir 204, the reservoir 206, and the non-producing formation 310. Wellbore completion assembly 304 includes a zone completion assembly 308 installed across the reservoir 204 and a zone completion assembly 312 installed across the reservoir 206. Each zone completion assembly 308 and 312 is modeled as having at least one flow control valve 306. Other components that would be included on the wellbore completion assembly 100 are not shown in the model for simplicity.

Figure 5:
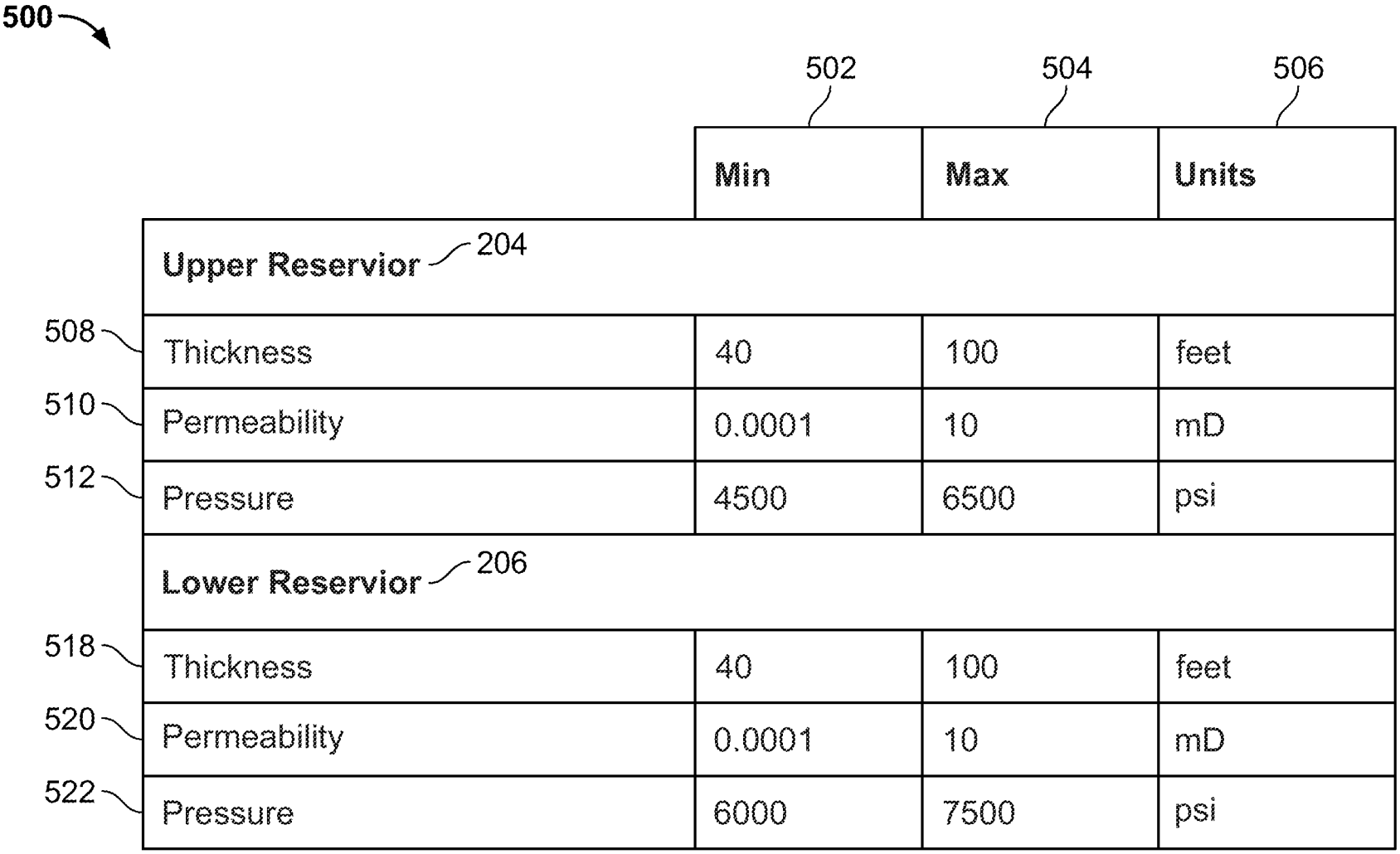
FIG. 5 is a table that illustrates ranges of sensitivity parameters for the reservoir model according to the present disclosure.

The combination of the reservoir model 200 and wellbore completion assembly model 300 were tested in 300 simulation sensitivities (simulation runs). For each sensitivity, reservoir properties (average permeability, thickness and initial pressure) were randomly varied over the range that are expected to be encountered in actual target reservoir. FIG. 5 illustrates a table 500 showing the varied parameters. As shown in table 500, the parameters of thickness 508, permeability 510, and pressure 512 were varied for the reservoir 204 from the illustrated minimum values 502 to the illustrated maximum values 504 (with units shown in column 506). The parameters of thickness 518, permeability 520, and pressure 522 were varied for the reservoir 206 from the illustrated minimum values 502 to the illustrated maximum values 504 (with units shown in column 506).

In some aspects, the set of parameters (shown in table 500) for each sensitivity was obtained by Latin hypercube sampling, assuming equiprobable distribution for each parameter. Latin hypercube sampling ensures that the range of possible outcomes is fully explored and can achieve this with significantly fewer number of samples (i.e., sensitivities) compared to the standard Monte Carlo sampling and other near-random sampling methods.

This allowed the sensitivities to test the example wellbore completion assembly for various combinations of reservoir properties and to establish viability for different reservoirs expected to be encountered. In the simulation, each sensitivity case was run twice-first with conventional comingled well completion (in other words, without the wellbore completion assembly model 300) and then a second time with the wellbore completion assembly model 300 that models the example wellbore completion assembly 100.

Figure 4A:
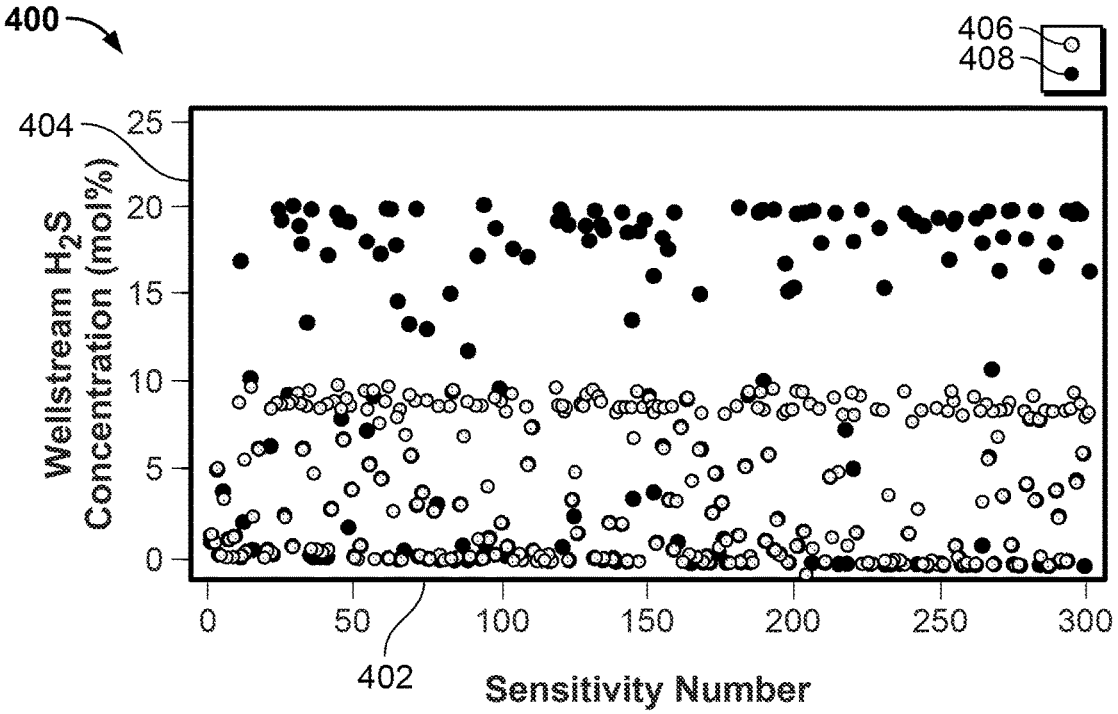
FIGS. 4A and 4B are graphs that illustrate outputs of the reservoir and wellbore completion assembly models according to the present disclosure.
Figure 4B:
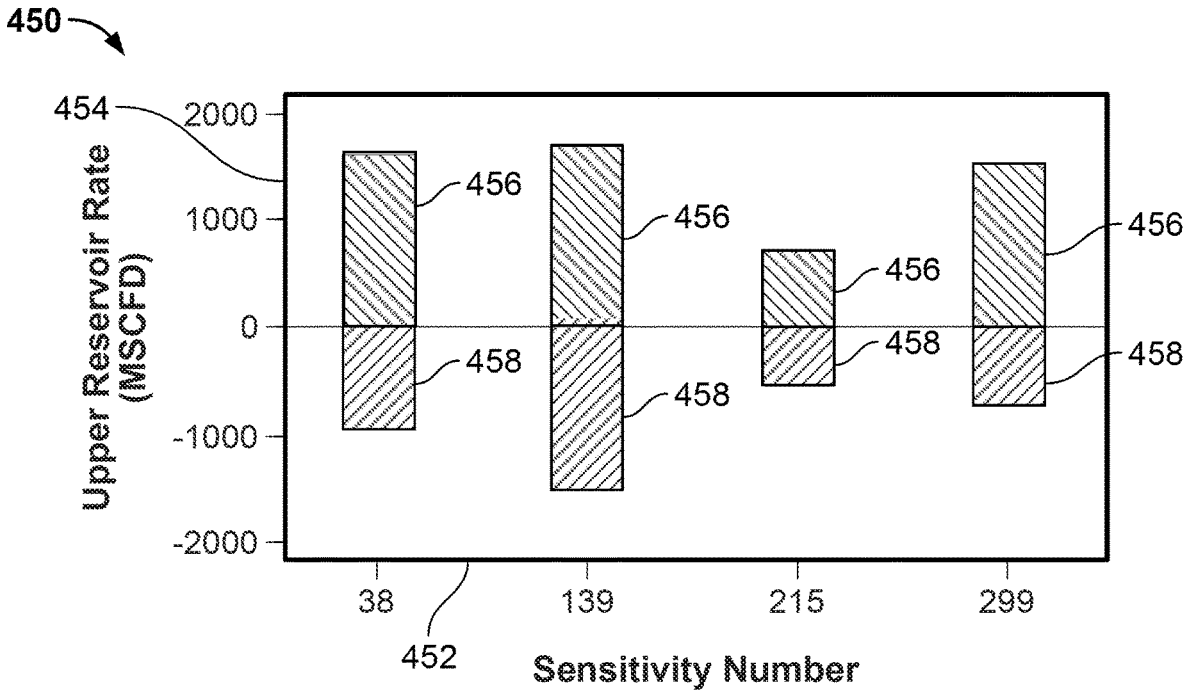

The results of the simulation sensitivities are summarized in FIGS. 4A and 4B. FIGS. 4A and 4B are graphs 400 and 450 that illustrate outputs of the reservoir and wellbore completion assembly models 200 and 300 according to the present disclosure. FIG. 4A illustrates graph 400, which shows wellstream $H_2S$ concentration obtained from conventional completions 408 and modeled completions 406 using the wellbore completion assembly model 300 sensitivity cases. As shown, graph 400 includes x-axis 402, which shows the sensitivity number, and y-axis 404, which shows wellstream $H_2S$ concentration in mol %.

As shown in FIG. 4A, the modeled completions 406 show active regulation of inflow contribution from the reservoir 204 (high $H_2S$) and the reservoir 206 (zero $H_2S$) zones. This allows a wellstream $H_2S$ composition to be achieved that does not exceed a threshold value of, in this example, 10 mol % $H_2S$ limit (as shown by the modeled completions 406), despite producing from the reservoir 204 with up to 20.4 mol % $H_2S$ concentration. The sensitivities confirm that this is possible for the range of reservoir properties that are expected to be encountered in practice.

On the other hand, conventional comingled well completions 408 do not allow active regulation of inflow contribution from either reservoirs 204 or 206. The wellstream $H_2S$ composition is then determined by the relative properties of each reservoir (permeability, thickness, pressures, etc.) so that the wellstream $H_2S$ composition is often higher than the threshold of 10 mol % (which is undesirable and unsafe).

As shown in FIG. 4A, the 10 mol % or less wellstream $H_2S$ composition can occur for some conventional completions 408 when the reservoir 206 dominates the reservoir 204. Although the wellstream $H_2S$ composition is within the safe limit in those particular completions 408, such cases may still be considered to be undesirable due to the possibility of crossflow (through the conventional completion assembly) from the reservoir 206 into the reservoir 204.

Some examples of this are shown in FIG. 4B. FIG. 4B shows graph 450, which shows the gas rate for reservoir 204 for four sensitivity scenarios as shown by x-axis 452. FIG. 4B shows conventional completions 458 and modeled completions 456. As shown by the y-axis 454, units are in thousands of SCF per day.

Negative rates in FIG. 4B indicate crossflow from reservoir 206 into reservoir 204. Crossflow only happens for the cases with conventional comingled well completions 458. In this context, crossflow is undesirable as it can lead to stranded reserves in the reservoir 204 (the high $H_2S$ reservoir zone). However, the modeled completions 456 (representing the wellbore completion assembly model 300) avoid crossflow, allowing both safe, controllable, and optimal exploitation of the reservoir 204.

Figure 6:
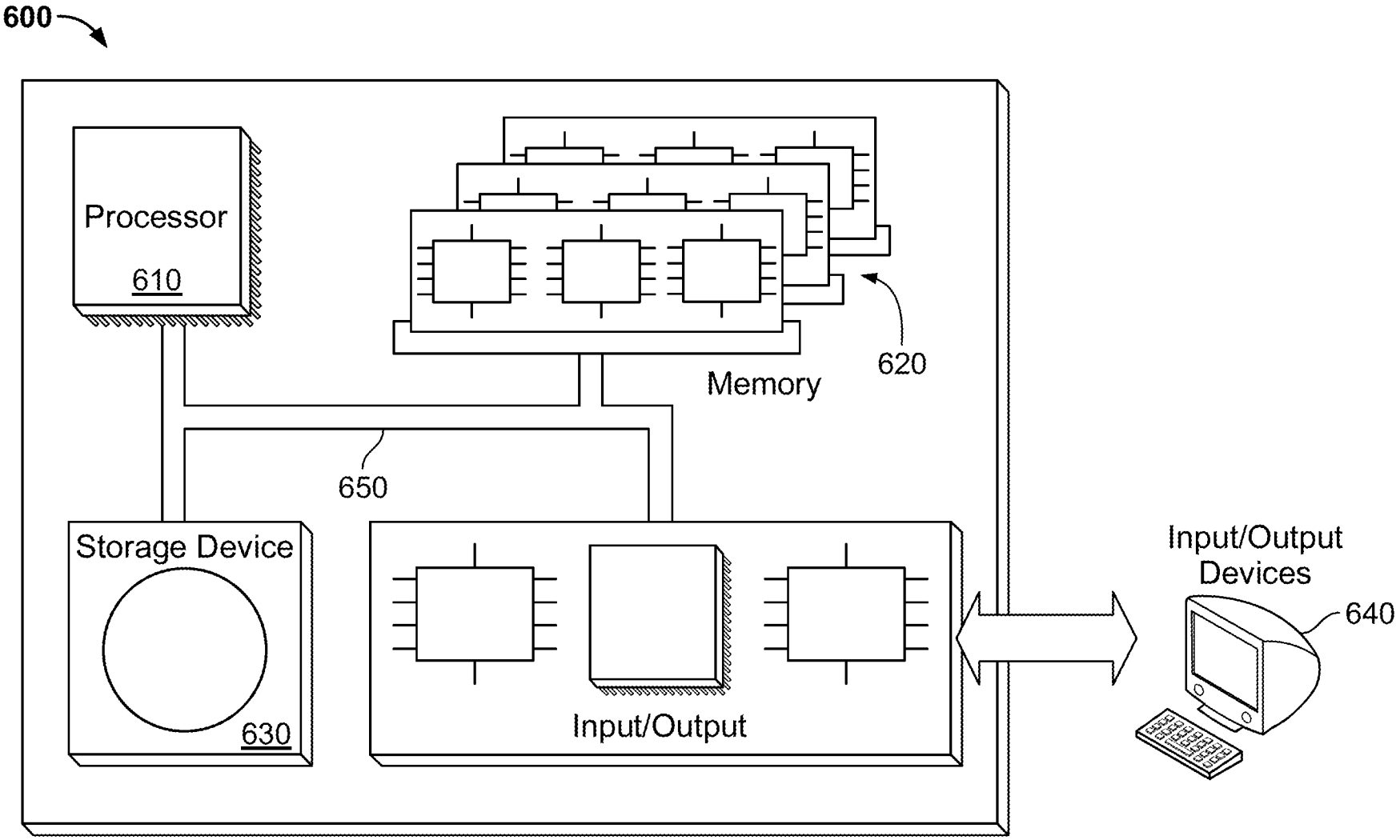
FIG. 6 is a schematic illustration of a controller or control system for a reservoir modeling system according to the present disclosure.

FIG. 6 is a schematic illustration of a controller or control system for a reservoir modeling system according to the present disclosure. For example, the controller 600 can be used for modeling the reservoir 200, the wellbore completion assembly model 300, or other models according to the present disclosure. The controller 600 can also be used, for example, as the control system 19.

The controller 600 is intended to include various forms of digital computers, such as printed circuit boards (PCB), processors, digital circuitry, or otherwise that is part of a vehicle. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 600 includes a processor 610, a memory 620, a storage device 630, and an input/output device 640. Each of the components 610, 620, 630, and 640 are interconnected using a system bus 650. The processor 610 is capable of processing instructions for execution within the controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the controller 600. In one implementation, the storage device 630 is a computer-readable medium. In various different implementations, the storage device 630 may be a floppy disk device, a hard disk device, an optical disk device, a tape device, flash memory, a solid state device (SSD), or a combination thereof.

The input/output device 640 provides input/output operations for the controller 600. In one implementation, the input/output device 640 includes a keyboard and/or pointing device. In another implementation, the input/output device 640 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole completion assembly, comprising:

a production tubular installed in a wellbore from a terranean surface into a first subterranean zone and a second subterranean zone, the first subterranean zone comprising a first formation fluid that comprises a first mixture of a hydrocarbon fluid and a first concentration or amount of an acid gas, the second subterranean zone comprising a second formation fluid that comprises a second mixture of the hydrocarbon fluid and a second concentration or amount of the acid gas different than the first concentration or amount;

a first zone completion assembly coupled to the production tubular in the wellbore adjacent the first subterranean zone, the first zone completion assembly comprising at least one first flow control valve configured to circulate the first formation fluid into the production tubular;

a second zone completion assembly coupled to the production tubular in the wellbore adjacent the second subterranean zone, the second zone completion assembly comprising at least one second flow control valve configured to circulate the second formation fluid into the production tubular; and a control system configured to perform operations comprising:

comparing an amount or percentage of the acid gas in a production fluid that is produced to the terranean surface to a threshold value, the production fluid comprising a mixture of the first and second formation fluids, the threshold value between the first concentration or amount of the acid gas and the second concentration or amount of the acid gas; and modulating at least one of the first or second flow control valves in response to the comparison so that the production fluid meets the threshold value of the amount or percentage of the acid gas.

2. The downhole completion assembly of claim 1, comprising at least one wellbore seal positioned in an annulus between the production tubular and the wellbore and between the first and second zone completion assemblies.

3. The downhole completion assembly of claim 2, comprising at least one sensor coupled to the production tubing and configured to sense the amount or percentage of the acid gas in the production fluid, wherein the operations comprise comparing the sensed amount or percentage of the acid gas in the production fluid to the threshold value.

4. The downhole completion assembly of claim 2, wherein the first zone completion assembly comprises a first flow meter configured to measure a flow rate of the first formation fluid circulated into the production tubular, and the second zone completion assembly comprises a second flow meter configured to measure a flow rate of the second formation fluid circulated into the production tubular.

5. The downhole completion assembly of claim 4, wherein the operations comprise:

determining a first amount of the acid gas in the flow of the first formation fluid based on the measured flow rate of the first formation fluid by the first flow meter and the first concentration or amount;

determining a second amount of the acid gas in the flow of the second formation fluid based on the measured flow rate of the second formation fluid by the first flow meter and the second concentration or amount; and determining the amount or percentage of the acid gas in the production fluid based on the determined first and second amounts and the measured flow rates of the first and second formation fluids.

6. The downhole completion assembly of claim 5, wherein the first and second concentration or amounts are specified values based on the first and second subterranean zones.

7. The downhole completion assembly of claim 5, wherein the operation of determining the amount or percentage of the acid gas in the production fluid based on the determined first and second amounts and the measured flow rates of the first and second formation fluids comprises determining a volume weighted average of the amount or percentage of the acid gas in the production fluid based on the determined first and second amounts and the measured flow rates of the first and second formation fluids.

8. The downhole completion assembly of claim 2, wherein the first and second flow control valves comprise remotely controlled inflow control valves.

9. The downhole completion assembly of claim 8, wherein the operation of modulating at least one of the first or second flow control valves in response to the comparison so that the production fluid comprises the threshold value of the amount or percentage of the acid gas comprises providing at least one signal from the terranean surface to the at least one of the first or second flow control valves to cause modulation of the at least one of the first or second flow control valves.

10. The downhole completion assembly of claim 2, wherein the operation of modulating at least one of the first or second flow control valves in response to the comparison so that the production fluid meets the threshold value of the amount or percentage of the acid gas comprises modulating the first and second flow control valves in response to the comparison so that the production fluid meets the threshold value of the amount or percentage of the acid gas.

11. The downhole completion assembly of claim 2, wherein the second concentration or amount of the acid gas is less than the first concentration or amount of the acid gas.

12. The downhole completion assembly of claim 11, wherein the first concentration or amount of the acid gas comprises a concentration of about 20 mol % of the acid gas, and the second concentration or amount of the acid gas comprises a concentration of about 0 mol % of the acid gas.

13. The downhole completion assembly of claim 2, wherein the acid gas comprises hydrogen sulfide.

14. The downhole completion assembly of claim 1, comprising at least one sensor coupled to the production tubing and configured to sense the amount or percentage of the acid gas in the production fluid, wherein the operations comprise comparing the sensed amount or percentage of the acid gas in the production fluid to the threshold value.

15. The downhole completion assembly of claim 14, wherein the acid gas comprises hydrogen sulfide.

16. The downhole completion assembly of claim 1, wherein the first zone completion assembly comprises a first flow meter configured to measure a flow rate of the first formation fluid circulated into the production tubular, and the second zone completion assembly comprises a second flow meter configured to measure a flow rate of the second formation fluid circulated into the production tubular.

17. The downhole completion assembly of claim 16, wherein the operations comprise:

determining a first amount of the acid gas in the flow of the first formation fluid based on the measured flow rate of the first formation fluid by the first flow meter and the first concentration or amount;

determining a second amount of the acid gas in the flow of the second formation fluid based on the measured flow rate of the second formation fluid by the first flow meter and the second concentration or amount; and determining the amount or percentage of the acid gas in the production fluid based on the determined first and second amounts and the measured flow rates of the first and second formation fluids.

18. The downhole completion assembly of claim 17, wherein the first and second concentration or amounts are specified values based on the first and second subterranean zones.

19. The downhole completion assembly of claim 17, wherein the operation of determining the amount or percentage of the acid gas in the production fluid based on the determined first and second amounts and the measured flow rates of the first and second formation fluids comprises determining a volume weighted average of the amount or percentage of the acid gas in the production fluid based on the determined first and second amounts and the measured flow rates of the first and second formation fluids.

20. The downhole completion assembly of claim 19, wherein the acid gas comprises hydrogen sulfide.

21. The downhole completion assembly of claim 1, wherein the first and second flow control valves comprise remotely controlled inflow control valves.

22. The downhole completion assembly of claim 21, wherein the operation of modulating at least one of the first or second flow control valves in response to the comparison so that the production fluid comprises the threshold value of the amount or percentage of the acid gas comprises providing at least one signal from the terranean surface to the at least one of the first or second flow control valves to cause modulation of the at least one of the first or second flow control valves.

23. The downhole completion assembly of claim 1, wherein the operation of modulating at least one of the first or second flow control valves in response to the comparison so that the production fluid meets the threshold value of the amount or percentage of the acid gas comprises modulating the first and second flow control valves in response to the comparison so that the production fluid meets the threshold value of the amount or percentage of the acid gas.

24. The downhole completion assembly of claim 1, wherein the second concentration or amount of the acid gas is less than the first concentration or amount of the acid gas.

25. The downhole completion assembly of claim 24, wherein the first concentration or amount of the acid gas comprises a concentration of about 20 mol % of the acid gas, and the second concentration or amount of the acid gas comprises a concentration of about 0 mol % of the acid gas.

26. The downhole completion assembly of claim 1, wherein the acid gas comprises hydrogen sulfide.

* * * * *